US006372012B1

(12) United States Patent
Majagi et al.

(10) Patent No.: US 6,372,012 B1
(45) Date of Patent: Apr. 16, 2002

(54) SUPERHARD FILLER HARDMETAL INCLUDING A METHOD OF MAKING

(75) Inventors: Shivanand Majagi, Rogers, AR (US); Jimmy W. Eason, The Woodlands, TX (US); Robert W. Britzke, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 09/616,112

(22) Filed: Jul. 13, 2000

(51) Int. Cl.[7] ..... C22C 26/00; C22C 29/00

(52) U.S. Cl. ..... 75/236; 75/232; 75/238; 75/242; 75/243

(58) Field of Search ..... 45/232, 236, 238, 45/242, 243; 419/11, 12, 13, 14, 18, 19, 23, 32, 35, 48

(56) References Cited

U.S. PATENT DOCUMENTS

| | | | | |
|---|---|---|---|---|
| 4,070,184 A | | 1/1978 | Scheithauer, Jr. et al. | 75/203 |
| 4,171,973 A | | 10/1979 | Hara et al. | 75/237 |
| 4,231,762 A | | 11/1980 | Hara et al. | 51/309 |
| 4,303,442 A | | 12/1981 | Hara et al. | 75/243 |
| 4,428,906 A | | 1/1984 | Rozmus | 419/48 |
| 4,547,337 A | | 10/1985 | Rozmus | 419/49 |
| 4,554,130 A | | 11/1985 | Ecer | 419/8 |
| 4,591,481 A | | 5/1986 | Lueth | 419/26 |
| 4,604,106 A | | 8/1986 | Hall et al. | 51/293 |
| 4,724,121 A | | 2/1988 | Weyand | 419/19 |
| 4,744,943 A | | 5/1988 | Timm | 419/10 |
| 4,808,224 A | | 2/1989 | Anderson et al. | 75/246 |
| 4,915,605 A | | 4/1990 | Chan et al. | 419/6 |
| 4,923,512 A | | 5/1990 | Timm et al. | 75/237 |
| 4,933,140 A | | 6/1990 | Oslin | 419/23 |
| 4,945,073 A | | 7/1990 | Dubensky et al. | 501/93 |
| 4,975,414 A | | 12/1990 | Meeks et al. | 505/1 |
| 4,980,340 A | | 12/1990 | Anderson et al. | 505/1 |
| 5,032,352 A | | 7/1991 | Meeks et al. | 419/8 |
| 5,045,277 A | | 9/1991 | Penkunas et al. | 419/15 |
| 5,104,422 A | | 4/1992 | St. Pierre | 51/295 |
| 5,106,392 A | | 4/1992 | Slutz et al. | 51/295 |
| 5,143,523 A | | 9/1992 | Matarrese | 51/293 |
| 5,156,725 A | | 10/1992 | Doktycz et al. | 204/192.16 |
| 5,190,796 A | | 3/1993 | Iacovangelo | 427/304 |
| 5,215,945 A | | 6/1993 | Dubensky et al. | 501/94 |
| 5,223,640 A | | 6/1993 | Tafesh et al. | 562/466 |
| 5,232,469 A | | 8/1993 | McEachron et al. | 51/295 |
| 5,232,522 A | | 8/1993 | Doktycz et al. | 148/218 |
| 5,250,086 A | | 10/1993 | McEachron et al. | 51/309 |
| 5,256,608 A | | 10/1993 | Dubensky et al. | 501/94 |
| 5,300,129 A | | 4/1994 | Clark | 51/295 |
| 5,374,392 A | | 12/1994 | Skelcey et al. | 419/49 |
| 5,476,531 A | | 12/1995 | Timm et al. | 75/240 |
| 5,697,046 A | | 12/1997 | Conley | 428/547 |
| 5,773,735 A | | 6/1998 | Dubensky et al. | 75/240 |
| 5,776,593 A | | 7/1998 | Massa et al. | 428/212 |
| 5,789,686 A | | 8/1998 | Massa et al. | 75/240 |
| 5,889,219 A | * | 3/1999 | Moriguchi et al. | 75/236 |
| 5,922,978 A | | 7/1999 | Carroll | 75/240 |
| 5,955,186 A | | 9/1999 | Grab | 428/312.8 |
| 6,024,909 A | | 2/2000 | Yoshida et al. | 264/430 |

FOREIGN PATENT DOCUMENTS

EP 0579376 5/1999

OTHER PUBLICATIONS

Kirk–Othmer, Encyclopedia of Chemical Technology; 3rd Edition, vol. 4, pp. 666–688.
Kirk–Othmer, Encyclopedia of Chemical Technology; 3rd Edition, vol. 15, pp. 241–274.
Kirk–Othmer, Encyclopedia of Chemical Technology; 3rd Edition, vol. 23, pp. 273–309.
Kennametal Inc.; Hot Press Diamond Matrix Powders; pp. 1–31; 1986.
Kennametal Inc., Infiltration Diamond Matrix Powders; pp. 1–27; 1986.
R.L. Mehan, L.E. Hibbs; Thermal Degridation of Sintered Diamond Compacts; pp. 942–950; 1989.
T.J. Clark & R.C. Devries; Metals Handbook; 10th Edition, vol. 2, pp. 1008–1018.
Ronald F. Balazik; Diamond, Industrial; pp. W1–W4; 1998.
J.D. Dwan; Powder Metallurgy; vol. 41, No. 2, pp. 84–86; 1998.
Materials Science & Engineering; pp. 257–262; 1990.
Dr. B.N. Thakur; Industrial Diamond Review; pp. 91–93; 1997.
Kennametal Inc., Metallurgy of Diamond Tools; pp. 248–250; 1985.
Published by the PR Department of OSRAM GmbH, Munich; Electronic Control Systems and Consumer Luminaries, pp. 29–48; Printed from the Internet.
GE SuperAbrasives; New MBG Diamond for Demanding Grinding Applications; pp. 1–7; Printed from the Internet.
Production Flow; Quality Control Production Process; p. 1; Printed from the Internet.

* cited by examiner

*Primary Examiner*—Ngoclan Mai
(74) *Attorney, Agent, or Firm*—Kevin P. Weldon

(57) ABSTRACT

A superhard filler hardmetal having a superhard material filler, binder metal or matrix and in some instances at least a first hard component is disclosed. The superhard filler hardmetal has a porosity rating of substantially A06, B00, C00 or better and may be essentially pore free, i.e., A00, B00, C00. The superhard filler hardmetal is formed by mechanically mixing a superhard material, in some instances at least a first hard component and a binder metal or matrix precursor, shaping the mixture into a green body and consolidating the green body at a preselected temperature, superatmospheric pressure and time at temperature and time at superatmospheric pressure sufficient to form the superhard filler hardmetal. The consolidation preferably occurs without the formation of a liquid in the body and at least a portion of the time at superatmospheric pressure is at the preselected temperature. Diamond filler and boron nitride filler are examples of superhard materials usable as filler. The diamond filler may be coated to prevent its degradation during consolidation and use. Boron nitride filler optionally may be coated.

40 Claims, 2 Drawing Sheets

SUPERHARD FILLER HARDMETAL INCLUDING A METHOD OF MAKING

BACKGROUND

The degradation of diamond limits its use as filler in hardmetals (e.g., cemented carbide and cermets). The degradation occurs during fabrication and use. Forms of diamond degradation include reversion to graphite, oxidation, dissolution, cracking and reaction. Diamond's Knoop 100 hardness is 75–100 gigapascal (GPa) and greater. The next hardest known substance cubic boron nitride has a Knoop 100 hardness of about 45 GPa. Both are called superhard materials. Engineer and scientists have endeavored to incorporate this hardest known substance in materials but diamond's degradation persists.

Diamonds in materials made using hot-press matrix powders dissolve in base metals, react with the base metal to from carbides, oxidize, and degrade to graphite. Hot-press matrix powders are designed to be mixed with synthetic diamonds to make tools for sawing, drilling, grinding and honing materials such as stone, rock, green concrete, concrete, reinforced concrete, asphalt, refractories, and glass. Hot-press matrix powders include at least tungsten metals or various tungsten carbide species and a base metal. Base metals include metals and their alloys such as cobalt, tungsten, iron, nickel, and copper. The solubility of carbon in cobalt, nickel, and iron; the existence of carbides of cobalt, tungsten, and iron; and the oxygen in copper provide explanations for the observed degradation of diamond in materials made using hot-press matrix powders.

Diamonds surface set on or mixed in materials made using infiltration alloys dissolve, oxidize, crack, and degrade to graphite. Infiltration alloys are designed to wet powders of at least tungsten metals or various tungsten carbide species including synthetic diamonds either surface set or intimately mixed in to make tools such as bits, core bits, drill bits, and polycrystalline bit bodies, for dressing, sawing, and drilling, grinding. Infiltration alloys include a major constituent such as copper, nickel, zinc, manganese, and cobalt with small amounts of one or two other elements such as iron, molybdenum, silicon, silver, lead and perhaps lead. The solubility of carbon in cobalt, nickel, and iron; the existence of carbides of cobalt, tungsten, silicon, molybdenum and iron; the swelling and shrinking during eta reaction to precrack diamond and the oxygen in copper provide explanations for the observed degradation of diamond in materials made using infiltration alloys.

Diamonds in materials (sintered polycrystalline diamond) made using liquid-phase sintering oxidize, crack, and degrade to graphite. Sintered polycrystalline diamond, in addition to containing about 5 to 10 volume percent of a metal phase such as cobalt, nickel and iron, may include graphite and are used in tools in the metalworking, mining and construction. Ironically, the cobalt, nickel and iron that catalyze the high-pressure high-temperature conversion of graphite to diamond, catalyze the reversion of diamond to graphite at about 700° C. at about atmospheric pressure. Sintered polycrystalline diamond bodies are size limited by heating pressurizing equipment.

It is apparent that there is a need for a superhard hardmetal (a hardmetal including a superhard material such as a diamond filler, a boron nitride filler, a carbon boron nitride and combinations thereof). Also, it is apparent that there is a need for a method for making a superhard filler hardmetal. There is also a need for superhard filler hardmetal having sizes and shapes unattainable by the high-pressure high-temperature process.

SUMMARY

The present invention satisfies the need for a superhard filler hardmetal (e.g., cermet or cemented carbide). Also, the present invention satisfies the need for a method for making a superhard filler hardmetal. The present invention also satisfies the need for a superhard filler hardmetal having sizes and shapes unattainable by the high-pressure high-temperature process.

In an embodiment of the present invention, a binder metal or matrix embeds a single crystal and/or polycrystalline superhard filler to create superhard filler hardmetal hating substantially little to no porosity, preferably, a porosity rating of substantially A06, B00, C08 or better, more preferably A02, B00 and C00 or better, and most preferably A00, B00 & C00. The superhard filler may make-up about 1 vol. % to about 80 volume percent (vol. %) and have a grain size of about submicron to about 1500 micrometers Preferred superhard filler included diamond, boron nitride and carbon nitride. In addition to the superhard filler, the superhard filler hardmetal may include at least one first hard component of, for example, carbides, nitrides, borides, oxides, intermetallics, mixtures thereof, solid solutions thereof, and combinations thereof. Also in addition to the first hard component the superhard filler hardmetal may include additional hard components of, for example carbides, nitrides, borides, oxides, intermetallics, mixtures thereof, solid solutions thereof, and combinations thereof. The size or size distribution of the first hard component, the second hard component, . . . etc., and the superhard filler may each be unique and different, however, size or size distribution are preferably substantially the same. The superhard filler hardmetal may be incorporated into, for example, at least a portion of an oil field tool (e.g., a button), a petroleum industry or exploration tool (e.g., a button or portion of a button), a mining tool (e.g., a hard tip or portion of a hard tip), a construction tool (e.g., a hard tip or portion of a hard tip), and a material removal tool (e.g., a metal or nonmetal cutting insert or portion of an insert).

In an embodiment of the present invention, a coating is provide to superhard filler prior to incorporating it into the superhard filler hardmetal. The coating may have thickness up to about 2.0 $\mu$m or more. The coating has the same or different composition as the embedding binder metal or matrix. The coating may include one or more layers.

In another embodiment of the present invention, a superhard filler hardmetal is formed by consolidating a shaped green body of a mixture of a superhard filler and a binder metal or matrix precursor at a preselected temperature, superatmospheric pressure and time at temperature, the time and temperature at superatmospheric pressure being sufficient to form the superhard filler hardmetal without the forming a liquid.

In a preferred method, a consolidation method such as rapid omnidirectional compaction (ROC) is used. In this manner, the time at superatmospheric pressure is less than the time at temperature. For example, the time at superatmospheric pressure may be about 2 seconds to about 10 minutes, preferably, about 2 seconds to about 1 minute and the time at temperature may be about 10 minutes to about 6 hours, preferably, about 15 minutes to about 1 hour. The superatmospheric pressure may be at least about 10,000 pounds per square inch (psi) and at most about 1,000,000 psi.

DRAWINGS

These and other features, aspects and advantages of the present invention will be better understood with reference to the following description, appended claims, and accompanying drawings where:

DETAILED DESCRIPTION

A diamond filler hardmetal and a boron nitride filler hardmetal are examples of the numerous superhard filler hardmetals contemplated by the applicants of the present invention. First, aspects of a diamond filler hardmetal are discussed. Then, aspects of a boron nitride filler hardmetal are discussed. Additionally, aspects relating to the making of superhard filler hardmetals are discussed. Examples demonstrating of these and other aspects of embodiments of the present invention then follow.

Figure 1:
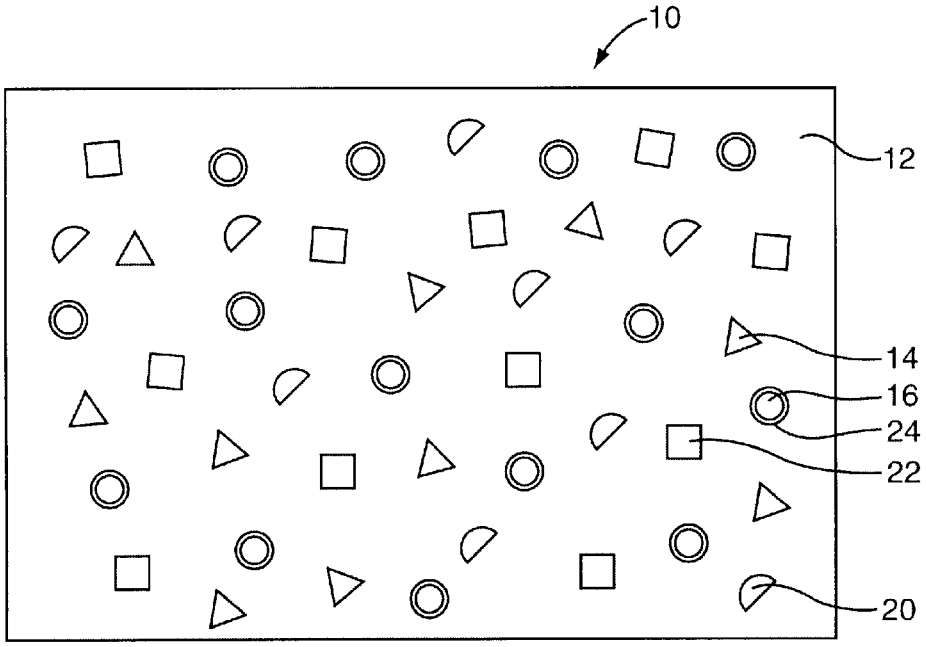
FIG. 1 depicts a cross-sectional schematic of a superhard filler hardmetal according to an embodiment of the present invention.
Figure 2:
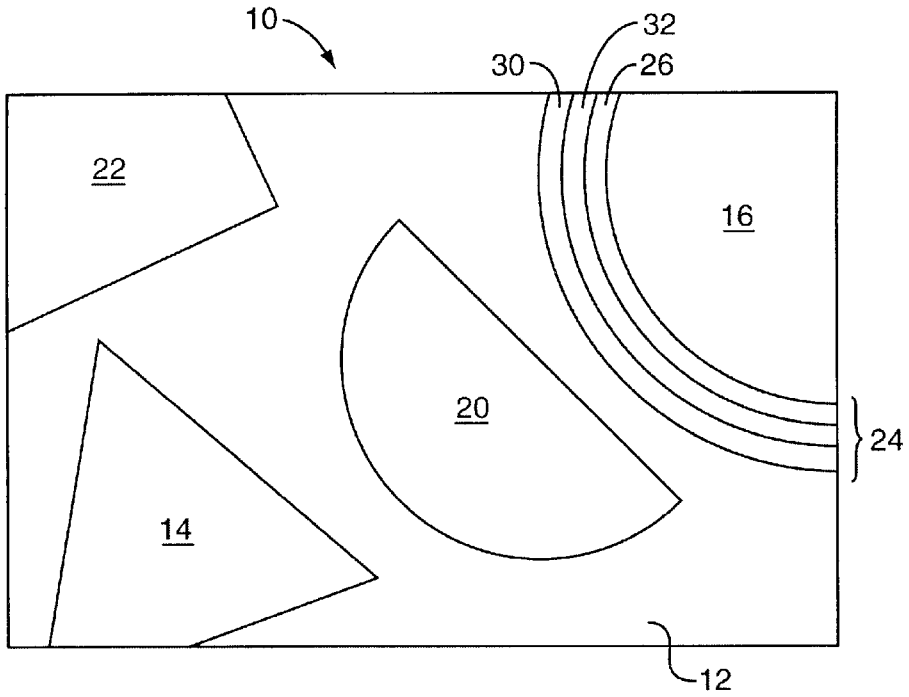
FIG. 2 depicts a higher magnification cross-sectional schematic of a superhard filler hardmetal according to an embodiment of the present invention.

Referring now to FIG. 1, a schematic of a microstructure of superhard filler hardmetal 10 according to an embodiment of the present invention is presented. The superhard filler hardmetal 10 comprises a binder metal or matrix 12, at least one superhard filler 16, and, optionally, at least a first hard component 14. Further, the superhard filler hardmetal 10 may comprise more hard components including a second hard component 20, a third hard component 22, and more. Although the superhard filler 16, the first hard component 14, the second hard component 20 and the third hard component 22 are depicted in FIGS. 1 and 2 as specific geometric shapes, no meaning should be given thereto.

In an aspect of the present invention, when at least a first hard component 14 is included along with a superhard filler 16 to form the superhard filler material hard metal 10, applicants have found that it is particularly advantageous to match the size or size distribution of the superhard filler material 16 and the first hard component 14. For example, when the first hard component 14 comprises tungsten carbide and the superhard filler 16 comprises a diamond filler, the size or size distribution of both fillers are substantially matched. Applicants have found that an advantage of such matching may include improved abrasion and rubbing wear resistance.

In an aspect of the present invention, a superhard filler 16 further includes a coating 24. The coating 20 on the superhard filler 16 may have any of a number of functions including preventing the direct contact of the superhard filler 16 and the binder metal or matrix 12 during consolidation and providing a transition layer between the superhard filler 16 and the binder metal or matrix 12 in the resulting superhard filler hardmetal 10.

Applicants contemplate that a coating 24 may comprise a single layer or multiple layers. As depicted in FIG. 2, a coating 24 comprising multiple layers may include a first layer 26 and an outer layer 30 that, for example, promotes metallurgical bonding with the binder metal or matrix 12. Also, applicants contemplate that one or more intermediate layers 32 (only one depicted in FIG. 2) may be included between the first layer 26 and the outer layer 30. Such one or more intermediate layers 32 may be selected to create chemical compatibility, physical compatibility, or both between the first layer 26 and the outer layer 30.

In regard to the numbering scheme of FIGS. 1 and 2, that numbering scheme is used in the discussion of the diamond filler hardmetal and the discussion of the boron nitride filler hardmetal. For example, the diamond filler hardmetal discussion refers to the diamond filler using a "16" and the boron nitride filler hard metal discussion also refers to the boron nitride filler using a "16" consistent with designating the superhard filler in FIGS. 1 and 2 using a "16".

Diamond Filler Hardmetal

When the superhard filler 16 comprises diamond filler 16 according to an aspect of the present invention, usable diamond may include natural, synthetic, chemical vapor deposition (CVD) diamond, or any combination of the preceding. Types of diamond filler 16 usable according to the present invention include single crystal, polycrystalline, or both. Thus, diamond filler 16 usable according to the present invention may be any combination of natural, synthetic, CVD, single crystal, and polycrystalline that satisfies the material property requirements for the use of the superhard filler hardmetal 10.

Sources of diamond filler 16 include manufactures and supplier of diamonds from throughout the world. Known suppliers include GE Superabrasives in Worthington, Ohio; Lieber & Solow, Ltd. New York, N.Y., USA; Debeers Consolidated Mines in South Africa; Far East Consulting Inc., 5130 Durham Road East, Columbia, Md. Suppliers are also in Russia, China, Korea, Australia, and Japan.

An amount of a diamond filler 16 included in a diamond filler hardmetal 10 according to an aspect of the present invention may range from about 1 volume percent (vol. %) to about 80 vol. % or greater. Applicants have observed that when the diamond filler 16 comprises polycrystalline diamond little, if any, diamond filler 16 pull out occurs at about 5 vol. % to about 50 vol. %. Volume percentages of diamond filler 16 less than about 1 vol. % are believed to be difficult to disperse uniformly in the starting powders and then consolidate to create a homogeneous diamond filler hardmetal 10. Volume percentages of diamond filler greater than about 80 vol. % are believed to exhibit little improvements in sliding wear at a great economic disadvantage. Preferred diamond filler contents range from about 3 vol. % to about 15 vol.%.

The size of a diamond filler 16 included in a diamond filler hardmetal 10 according to an aspect of the present invention may range from submicrometer to about 1500 micrometers ($\mu$m) or greater. Submicrometer includes nanostructured diamond filler having structural features ranging from about 1 nanometer to about 100 nanometers or more.

In an aspect of an embodiment relating to single crystal diamond filler 16, the size of a diamond filler 16 may range from about 1 $\mu$m to about 500 $\mu$m or greater. Preferred sizes of a single crystal diamond filler 16 range from about 5 $\mu$m to about 500 $\mu$m and, more preferably, from about 5 $\mu$m to about 30 $\mu$m.

In an aspect of an embodiment relating to polycrystalline diamond filler, the diamond filler 16 may be considered to include the size or size distribution of crystallites and agglomerates of the polycrystalline diamond. The size of agglomerates of polycrystalline diamond filler 16 may range from about 500 $\mu$m to about 3000 $\mu$m or greater. In contrast to a single crystal diamond filler 16, the size of crystallites within an agglomerate may range from about 2 $\mu$m to about 30 $\mu$m and greater.

Again, regarding polycrystalline diamond filler 16, diamond filler hard metals comprise about 1 vol. % to about 80 vol. %, preferably about 1 vol. % to about 50 vol. %, and more preferably up to about 25 vol. % polycrystalline diamond filler 16. Applicants have noticed that at polycrystalline diamond filler 16 contents of about 5 vol. % to about 50 vol. %, the diamond filler 16 is bound to the binder metal or matrix substantially eliminating diamond filler pullout during use.

In further regard to polycrystalline diamond agglomerates, the nature of the porosity of an agglomerate may determine its suitability as a diamond filler 16. For example, an agglomerate having substantially no porosity or porosity of a size or size distribution that is smaller than a critical flaw for a diamond filler hardmetal may be suitable as a diamond filler 16 because such an agglomerate should not be detrimental to the strength of the diamond filler hardmetal 10. In contrast, an agglomerate having porosity of a size or size distribution greater than a critical flaw may be detrimental to the strength of the diamond filler hardmetal 10 unless the porosity may be filled with binder metal or matrix during consolidation. A factor dictating whether a porous agglomerate may be suitable as a diamond filler 16 is the interconnectivity the porosity. Interconnected porosity may provide a path for the binder metal or matrix 12 to fill voids during consolidation to remove what otherwise may be a critical flaw. In contrast, an agglomerate having closed porosity may introduce a critical flaw making the diamond filler hardmetal susceptible to catastrophic failure.

In a preferred aspect of an embodiment of the present invention, a diamond filler 16 is coated. The coating 20 on the diamond filler 16 may have any of a number of functions including preventing the direct contact of the diamond filler 16 and the binder metal or matrix 12 during consolidation and providing a transition layer between the diamond filler 16 and the binder metal or matrix 12 in the resulting diamond filler hardmetal 10.

As discussed, diamond converts back to graphite at about 700° C. In the presence of oxygen, diamond reacts to a carbon monoxide/carbon dioxide mixture at about 700° C. The composition of a binder metal or matrix 12 influences the consolidation temperature of a diamond filler hardmetal. In an embodiment, the consolidation temperature exceeds 700° C. Applicants have found that a diamond filler 16 with a coating 24 results in a diamond filler hardmetal 10 rather than a porous hardmetal when a diamond filler 16 without a coating 24 either converts back to graphite, reacts to a gas, or both. Contrary to the convention that carbide-forming elements such as iron, cobalt, nickel, boron, titanium, vanadium, chromium, zirconium, hafnium, tantalum, tungsten, and silicon are detrimental to diamond and, would be particularly detrimental to a diamond filler 16, applicants have found that a coating comprising nickel and a coating comprising tungsten and copper protect a diamond filler 16 during consolidation above 700° C. to result in a diamond filler hardmetal 10.

Applicants believe that any of the above mentioned carbide-forming elements may be used alone, in combination as a layered structure, or as an alloy of two or more elements to produce a diamond filler hardmetal 10. Applicants believe that other carbide-forming elements that may be used to produce a diamond filler hardmetal 10 include niobium and molybdenum. Additionally, applicants believe that any of the above carbide-forming elements may be used in their elemental form, as alloys with each other, and as alloys with other elements. Further, applicants believe that the coating 24 may comprise any material or combination of materials that reduces or eliminates interaction between the binder metal or matrix 12 precursor and the diamond filler 16 during the consolidation of the diamond filler hardmetal 10. In that vain, applicants believe that any of the above carbide-forming elements may be used alone, in combination with each other, and in combination with other elements as any one of a carbide, a boride, a nitride, a carboboride, a carbonitride, a nitroboride, and a carboboronitride.

An unexpected benefit of a coating 24 according to the present invention includes the continued stability of the diamond filler 16 during the use of a diamond filler hardmetal 10. Further, a coating 24 may be used to enhance the bonding of the binder metal or matrix 12 to the diamond filler 16 to reduce or eliminate diamond filler 16 pull out. One unexpected benefit includes the reduction or prevention of material defects and, particularly, surface defects. That is, if the bond between a binder metal or matrix 12 and the diamond filler 16 is poor, the presence of the diamond filler 16 is equivalent to a material flaw. As discussed above, when the size of the flaw is greater than the critical flaw size for a hardmetal, the strength of the hardmetal is substantially reduced and the hardmetal is subject to catastrophic failure. Likewise, poorly bonded diamond filler at the surface of a hardmetal may create critical surface flaws. Such surface flaws may be especially detrimental to uses involving contacting wear.

Applicants contemplate that a coating 24 may comprise a single layer or multiple layers. As depicted in FIG. 2, a coating 24 comprising multiple layers may include a first layer 26 in contacting communication with a diamond filler 16 comprising, for example, at least one of the carbide-forming elements listed above, and an outer layer 30 that, for example, promotes metallurgical bonding with the binder metal or matrix 12. In a diamond filler hardmetal 10 according to the present invention, applicants contemplate that one or more intermediate layers 32 (only one depicted in FIG. 2) may be included between the first layer 26 and the outer layer 30. Such one or more intermediate layers 32 may be selected to create chemical compatibility, physical compatibility, or both between the first layer 26 and the outer layer 30.

Chemical compatibility includes such concepts as a diffusion barrier layer and a gettering layer. A diffusion barrier layer may include any composition that minimizes or prevents the diffusional transport of one or more elements from the binder metal or matrix 12 to the diamond filler 16 or vice versa. A gettering layer may include any composition that getters or combines chemically with one or more elements that may be detrimental to the chemical stability of any one of a diamond filler 16, a first layer 26, and an outer layer 30. The elements that may be detrimental may come from the diamond filler hardmetal 10, the environment to which the hardmetal 10 is exposed, or both.

Physical compatibility includes such concepts as a coefficient of thermal expansion (CTE) matching layers and a mechanically rough layers. The CTE matching layers accommodates transition between any one of the diamond filler 16, the binder metal or matrix 12, the first layer 26, and the outer layer 30 having disparate CTEs. The mechanically rough layers promotes mechanical bonding among the diamond filler 16, the coating 24, and the binder metal or matrix 12 of the hardmetal 10.

The thickness of a coating 24 should be sufficient to provide protection to a diamond filler 16 during at least consolidation. The use of the diamond filler hardmetal 10 may also be factor in specifying a coating thickness. One consideration regarding use may be providing sufficient material to accommodate a metallurgical bond between the coating 24 and the binder metal or matrix 12. The coating may range from about 0.01 $\mu$m to about 2 $\mu$m or greater.

Any technique or combination a of techniques that result in the coating meeting the above criteria may be used. For example, chemical vapor deposition (CVD), physical vapor deposition (PVD), variants thereof, and combinations thereof may be used. Typical CVD and low pressure CVD processes, systems, and devices are described in Kirk-Othmer Encyclopedia of Chemical Technology, Vol. 15, pp. 262–264(1981). Examples of suitable CVD and PVD methods include those disclosed in U.S. Pat. No. 6,024,909. Other coating techniques that may be used include electroplate coating, electroless coatings, and a pack cementation process. Typical electrolytic and electroless deposition processes, systems, and devices are described in Kirk-Othmer Encyclopedia of Chemical Technology, Vol. 15, pp. 241–274(1981). Another example of an electroless deposition process is that disclosed in U.S. Pat. No. 3,556,839. Another example of a pack cementation process is that disclosed in U.S. Pat. No. 2,746,888.

Boron Nitride Hardmetal Filler

Again referring to FIGS. 1 and 2, the boron nitride filler hardmetal 10 comprises a binder metal or matrix 12, at least a first hard component 14 and a boron nitride filler 16. Further, the boron nitride filler hardmetal 10 may comprise more hard components including a second hard component 20, a third hard component 22, and more. In an optional embodiment, a boron nitride filler 16 further includes a coating 24.

A boron nitride filler 16 included in a boron nitride filler hardmetal 10 according to the present invention may be high-pressure high-temperature synthesized, chemical vapor deposition (CVD), physical vapor deposition (PVD), or any combination of the preceding. Types of boron nitride filler 16 usable according to the present invention include single crystal, polycrystalline, or both. Types of boron nitride filler 16 usable according to the present invention include the various crystalline forms of boron nitride such as amorphous boron nitride (aBN), cubic boron nitride (cBN), hexagonal boron nitride (hBN), and wurtzitic boron nitride (wBN). Thus, a boron nitride filler 16 usable according to the present invention may be any combination of HP-HT synthesized, CVD synthesized, PVD synthesized, single crystal, polycrystalline, aBN, cBN, hBN, and wBN that satisfies the material property requirements for the use of the boron nitride filler hardmetal 10. Sources of boron nitride filler 16 include the manufactures and supplier of diamond discussed above.

An amount of a boron nitride filler 16 according to the present invention may range from about 1 vol. % to about 80 vol. % or greater. Preferred boron nitride filler amounts comprise about 3 vol. % to about 15 vol. %.

The size of a boron nitride filler 16 according to the present invention may range from submicrometer to about 1500 $\mu$m or greater. Submicrometer includes nanostructured boron nitride filler having structural features ranging from about 1 nanometer to about 100 nanometers or more.

In an aspect of an embodiment relating to single crystal boron nitride filler 16, the size of a boron nitride filler 16 may range from about 1 $\mu$m to about 500 $\mu$m or greater. Preferred sizes of a single crystal boron nitride filler 16 range from about 5 $\mu$m to about 500 $\mu$m and, more preferably, from about 5 $\mu$m to about 30 $\mu$m. Unlike polycrystalline diamond filler, applicants have noticed that boron nitride filler 16 did not exhibit pullout.

In an aspect of an embodiment of the present invention relating to polycrystalline boron nitride filler, the boron nitride filler 16 that may be considered include the size or size distribution of crystallites and agglomerates of the polycrystalline boron nitride. Applicants believe that the similar discussion relating to a diamond filler 16 also applies to a boron nitride filler 16.

In an optional aspect of an embodiment of the present invention, the boron nitride filler 16 is coated. Applicants believe that the similar discussion relating to a diamond filler provide the appropriate guidance for a boron nitride filler 16.

Superhard Filler Cemented Carbides

In an aspect of the present invention, the superhard filler hardmetal 10 comprises a cemented carbide. In this embodiment, the superhard filler hardmetal 10 further includes a first hard component 14 comprising a carbide of one or more metals from IUPAC groups 3 (including lanthanides and actinides), 4, 5, 6, their mixtures, their solutions, and any combination of the preceding. Preferably, the first hard component 14 comprises a carbide of one or more of Ti, Zr, Hf, V, Nb, Ta, Cr, Mo, W, their mixtures, their solutions, and any combination of the preceding. More preferably, the first hard component 14 comprises a carbide of tungsten, its mixtures, its solutions, any combination of the preceding. Silicon carbide is a first hard component 14 that applicants believe may be advantageously used with single crystalline diamonds. Intermetallics such as aluminides of nickel (e.g., $Ni_3Al$, NiAl, . . . , etc.), aluminides of titanium (e.g., TiAl, . . . , etc.), and alumina are other examples of a first hard component 14 that applicants believe may be advantageously used.

An amount of a first hard component 14 included in a superhard filler hardmetal 10 according to this aspect of an embodiment may make up the balance of the superhard filler hardmetal. That is, the superhard filler 16 may comprise about 1 vol. % to about 80 vol. %. The binder metal or matrix 12 may comprise up to about 25 vol. %, and the first hard component may make up the balance. Thus, if the superhard filler comprises about 65 vol. % and the binder metal or matrix comprises about 11 vol. %, the first hard component may comprise up to about 24 vol. %.

The size of a first hard component 14 according to this embodiment may range from submicrometer to about 500 $\mu$m or greater. Submicrometer includes nanostructured first hard component 14 having structural features ranging from about 1 nanometer to about 100 nanometers or more. As noted above, the size or size distribution of the superhard filler 16 and the first hard component are preferably matched. This matching creates a superhard filler hardmetal having superior properties and in particular when used in abrasion and rubbing wear.

In an aspect of an embodiment of the present invention relating to cemented carbides, in particular tungsten carbide and cemented carbide, the size of a first hard component 14 may range from submicron to about 500 $\mu$m or greater. Preferred sizes of a first hard component 14 comprising WC range from about 0.2 $\mu$m to about 20 $\mu$m.

Superhard Filler Cermets

In an alternative embodiment of the present invention, the superhard filler hardmetal comprises a cermet. In this alternative embodiment, the superhard filler hardmetal further includes a first hard component 14 comprising a carbonitride of one or more metals from IUPAC groups 3 (including lanthanides and actinides), 4, 5, 6, their mixtures, their solutions, and any combination of the preceding. Preferably, the first hard component 14 comprises a carbonitride of one or more of Ti, Zr, Hf, V, Nb, Ta, Cr, Mo, W, their mixtures, their solutions, and any combination of the preceding. More preferably, the first hard component 14 comprises a carbonitride of titanium, its mixtures, its solutions, any combination of the preceding.

An amount of a first hard component 14 included in a superhard filler hardmetal 10 according to this alternative embodiment may also make up the balance of the superhard filler hardmetal 10.

The size of a first hard component 14 according to this alternative embodiment may range from submicrometer to about 500 $\mu$m or greater. Submicrometer includes nanostructured first hard component 14 having structural features ranging from about 1 nanometer to about 100 nanometers or more.

In this alternative embodiment of the present invention relating to cermets, the size of a first hard component 14 may preferably be matched to the size of the superhard filler 16.

Binder Metal Or Matrix

In any of the preceding aspects of embodiments and/or embodiments, the binder metal or matrix 12 may comprise one or more metals from IUPAC groups 8, 9 and 10; more preferably, one or more of iron, nickel, cobalt, their mixtures, and their alloys. When the diamond filler hardmetal 10 comprises a cermet, the binder metal or matrix 10 even more preferably comprises nickel or nickel alloys such as nickel-iron alloys. When the diamond filler hardmetal 10 comprises a cemented carbide, the binder metal or matrix 10 even more preferably comprises cobalt or cobalt alloys such as cobalt-tungsten alloys. The binder metal or matrix 12 may comprise a single elemental metal, mixtures of metals, alloys of metals and any combination of the preceding.

An amount of binder metal or matrix 12 according to any of the above embodiments may comprise about 0 vol. % to about 20 vol. % or greater.

Additional Hard Components 20, 22, . . . , Etc.

In any of the preceding embodiments, a second hard component 20, a third hard component 22, and any additional hard components of a superhard filler hardmetal in any of the preceding embodiments may comprise at least one of boride(s), nitride(s), carbide(s), oxide(s), silicide(s), their mixtures, their solutions, and any combination of the proceeding. The metal of the at least one of borides, carbide, oxides, or silicides includes one or more metals from IUPAC groups 2, 3 (including lanthanides and actinides), 4, 5, 6, 7, 8, 9, 10, 11, 12, 13 and 14. Preferably, additional hard components comprise one of boride(s), nitride(s), carbide(s), oxide(s), or silicide(s) their mixtures, their solutions and any combination of the preceding. The metal of the of boride(s), nitride(s), carbide(s), oxide(s), or silicide(s) comprises one or more metals from IUPAC groups 3 (including lanthanides and actinides), 4, 5, and 6; and more preferably one or more of Ti, Zr, Hf, V, Nb, Ta, Cr, Mo and W. Silicon carbide is an additional hard component that applicants believe may be advantageously used with single crystalline diamonds. Other additioanl hard components or further hard components may include intermetallics such as aluminides of nickel (e.g., $Ni_3Al$, NiAl, . . . , etc.), aluminides of titanium (e.g., TiAl, . . . , etc.), and alumina.

Applicants contemplate that the first hard component 14, when included alone or in combination with a second hard component 20, a third hard component 22, and any additional hard components of a superhard filler hardmetal, may likewise comprise any of the above-mentioned boride(s), nitride(s), carbide(s), oxide(s), or silicide(s) their mixtures, their solutions and any combination of the preceding.

Making A Superhard Filler Hardmetal

A superhard filler hardmetal 10 may be produced using conventional powder metallurgical technology as described in, for example, "World Directory and Handbook of HARD-METALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel A G, Werkzeuge+Hartstoffe, Fuerth, Bavaria, Germany (1993); and "CEMENTED CARBIDES", by P. Schwarzkopf & R. Kieffer, The Macmillan Company (1960)—the subject matter of which is herein incorporated by reference in its entirety in the present application.

In forming a superhard filler hardmetal 10, a mixture of a superhard material 16, optionally a first hard component 14 and a binder metal or matrix 12 precursor is formed. Methods for forming such mixtures are described in, for example, U.S. Pat. Nos. 4,070,184; 4,724,121; 5,045,277 and 5,922,978, and include spray drying and mechanical mixing. The binder metal or matrix 12 precursor may be any source such as metal powders or composite powders previously described that may be intimately mechanically mixed with the superhard material and, when used, a first hard component 14. Preferably the binder metal or matrix 12 precursor is a metal powder that has an average particle size that is at most about 10 $\mu$m in diameter, more preferably at most about 5 $\mu$m, and most preferably at most about 2 $\mu$m in diameter. The binder metal or matrix 12 precursor powder is desirably of a purity that does not form undesirable phases or promote the formation of undesirable phases such as eta phases in the superhard filler hardmetal comprising tungsten carbide. Preferably the binder metal or matrix 12 precursor powder contains an amount of contaminants of at most about 1 percent by weight of the metal powder, contaminants being elements other than C, W, Fe, Co or Ni. More preferably the amount of contaminants is at most about 0.5 percent, and most preferably 0.2 percent by weight of the transition metal powder.

The mixture may also contain organic additives such as binders that improve the ability of the mixture to be shaped into a porous body. Representative binders include paraffin wax, synthetic waxes such as microcrystalline wax, or linear or branched chain polymers such as polyethylene or polypropylene. The binders, typically, are soluble in a solvent such as a straight chain alkane (e.g., heptane) that may be used to mix the components of the mixture together.

The mixture is formed by mechanically mixing the source of a superhard material, a binder metal or matrix 12 precursor and any optional components, such as a first hard component 14, organic additives, second hard component 20 or third hard component 22, previously described. The mechanical mixing may be any convenient form of mechanical mixing, such as ultrasonic agitating, ball milling, attriting, homogenizing v-blending or mixing and stirring, that intimately mixes the superhard filler 16, the first hard component 14 when used, and a binder metal or matrix 12 precursor. In an embodiment including a first hard component 14, diamond filler 16 and a binder metal or matrix 12 precursor, ball milling or attrition is preferably used. Also, the diamond filler 14 is added to the mixture after the first hard component 14 and a binder metal or matrix 12 precursor have been intimately mixed. In the way, the wear to the mixing equipment can be minimized.

The mixture, including the superhard filler 16 and the binder metal matrix 12 precursor may be mixed dry or in a solvent as long as the environment does not deleteriously oxidize or hydrolyze the mixture's components. Preferably, a mixture is prepared in a solvent such as a low molecular weight straight chain alkane such as octane, heptane or hexane, which may be, subsequently, removed by drying, the drying being a convenient method such as vacuum or spray drying The mixture is then formed into a green body by a convenient method such as those known in the art, examples being, uniaxial pressing in hard steel tooling, dry or wet bag cold isostatic pressing in rubber tooling, extrusion and injection molding. The particular method is selected primarily by the shape that is desired. For the present invention, uniaxial pressing, dry or wet bag isopressing produce satisfactory results.

Before consolidating, the green body may be heated to remove any organic additives that may have been added to aid processing. This heating, commonly referred to as dewaxing, may be performed at a temperature ranging from 300° C. to about 700° C. under vacuum, inert gas or reducing gas. A particularly suitable dewax cycle is heating to about 350° C. under vacuum for a time sufficient to remove most of the organic additives followed by heating to 450° C. in an atmosphere containing hydrogen gas. The green body is then consolidated at a temperature, superatmospheric pressure, time at temperature and time at superatmospheric pressure sufficient to form a densified diamond filler hardmetal, the consolidation occurring without the formation of a liquid in the body. The consolidation temperature should be sufficiently high to cause the green body to densify at the superatmospheric pressure described herein. The temperature should also be less than a temperature where a liquid phase is formed in the green body with little, if any, grain growth of the hard component. A suitable temperature range is from about 800° C. to about 1250° C., preferably from about 900° C. to about 1200° C., more preferably from about 1000° C. to about 1150° C., and most preferably from about 1050° C. to about 1150° C.

The consolidation time may be as short as possible while still forming the densified superhard filler hardmetal. When hard components are used, the consolidation time should be a time that fails to cause excessive grain growth of substantially all the hard component grains while still achieving the desired density of the hardmetal. Suitable times range from about 1 minute to about 24 hours. Preferably, the time is at most about 12 hours, more preferably at most about 6 hours, even more preferably at most about 3 hours, and most preferably at most about 1 hour to preferably at least about 5 minutes, more preferably at least about 10 minutes, and most preferably at least about 15 minutes.

The entire time or only a portion of the time at the consolidation temperature may be at the elevated pressure according to the present invention (i.e., the time at superatmospheric pressure is less than or equal to the time at temperature). For practical reasons, the time at superatmospheric pressure is advantageously as short as possible while still attaining the densified hardmetal 10.Preferably, the time at superatmospheric pressure at the consolidation temperature is at most about 30 minutes, more preferably at most about 10 minutes, even more preferably at most about 60 seconds and most preferably at most about 15 seconds to preferably at least about 2 seconds.

The superatmospheric pressure at the consolidation temperature should be at least a pressure such that the resulting superhard filler hardmetal is essentially free of porosity. The superatmospheric pressure should be less than a pressure, wherein the hardmetal would start to plastically deform to an extent where catastrophic failure of the hardmetal 10 may occur. Preferably, the superatmospheric pressure is at most about 1,000,000 pounds per square inch "psi" (6.89 GPa), more preferably at most about 500,000 psi (3.45 GPa) to at least about 10,000 (68.9 MPa) psi, more preferably at least about 50,000 psi (345 MPa), and most preferably at least about 100,000 psi (689 MPa).

Representative methods for consolidation the green body include Rapid Omnidirectional Compaction (ROC), placing a green body in a bed of pressure transmission particles, hot isostatic pressing (HIP), uniaxial hot pressing, or pressureless or vacuum sintering followed by one of the aforementioned superatmospheric techniques, an example being sinter-HIP. Various aspect of using a bed of pressure transmitting particles are taught by Meeks et al. (U.S. Pat. Nos. 5,032,352 and 4,975,414); Anderson et al. (U.S. Pat. Nos. 4,980,340 and 4,808,224); Oslin (U.S. Pat. No. 4,933,140); and Chan et al. (U.S. Pat. No. 4,915,605). Various aspects of sinter-HIP are taught by Lueth (U.S. Pat. Nos. 4,591,481 and 4,431,605). Preferably, the method consolidation comprises ROC-various aspects being taught by Timm (U.S. Pat. No. 4,744,943), Lizenby (U.S. Pat. Nos. 4,656,002 and 4,341,557), Rozmus (U.S. Pat. No. 4,428,906) and Kelto (Metals Handbook, "Rapid Omnidirectional Compaction" Vol. 7, pages 542–546), the subject matter of each is hereby incorporated in its entirety herein by reference.

In the ROC process according to the present invention, the green body is first embedded in a pressure transmitting material that acts like a viscous liquid at the consolidation temperature, the material and green body being contained in a shell. The green body may be enveloped in a barrier layer such as graphite foil or boron nitride. Suitable pressure transmitting materials include glasses that have sufficient viscosity so that the glass fails to penetrate the body under an applied pressure. Representative glasses include glasses containing high concentrations of silica and boron. A commercial glass useful in the temperature range from 1000° C. to 1400° C. is Corning-type PYREX 7740™ glass. Pressure transmitting materials are described in more detail in U.S. Pat. Nos. 4,446,100; 3,469,976; 3,455,682 and 4,744,943. Each patent relating to consolidation incorporated herein by reference in their entirety.

The shell containing the green body or green bodies and pressure transmitting medium preferably forms an enclosed right cylinder that can be placed in pot die tooling of a forging press. The pot die tooling, as it is known in the forging industry, consists of a cylindrical cavity closed at one end by an ejector assembly and at the other by a cylindrical ram. Upon compression in the tooling, the shell must distort predictably and not crack or leak.

The preferred shell material for the temperature range from 150° C. to about 1650° C. using glass pressure transmitting media is a shell cast of a thixotropic ceramic, as described by U.S. Pat. No. 4,428,906, at col. 3, lines 58–68, and col. 4, lines 1–27, incorporated herein by reference. The thixotropic ceramic material comprises a ceramic skeleton network and pressure transmitting material that deforms or fractures allowing compression of the pressure transmitting material, while retaining enough structural integrity to keep the pressure transmitting fluid from leaking out of the pot die.

Once the green body or bodies are embedded in the pressure transmitting material contained in the shell, this shell assembly is heated in an inert atmosphere to a temperature suitable for forging. The temperature of this step is as described previously. The time at temperature must be a time sufficient to completely fluidize the pressure transmitting medium and to bring the green bodies to a temperature roughly in equilibrium with the temperature of the pressure transmitting material. Typical times range from about 1 to 3 hours for both heating to the consolidation temperature and maintaining the consolidation temperature. The time at the sintering temperature is maintained generally from about 1 to 30 minutes before being pressed in the pot die of the forging pressed described below.

The heated shell assembly is pressed in a forging press as described below and by Timm, U.S. Pat. No. 4,744,943, at col. 9, lines 50 68, and col. 10, lines 1 3, incorporated herein by reference. The heated shell is pressed in the forging press by compressing the assembly with a ram in a closed cavity such as the pot die tooling previously described. As the ram compresses the assembly in the cavity, the pressure transmitting material exerts a large hydrostatic pressure on the articles to densify them. The shell material of the assembly flows into the clearance between the ram and pot die and forms, in effect, a pressure seal so that the liquid pressure transmitting material does not escape into the pot die. After pressing, the shell assembly is ejected from the pot die.

After ejection from the pot die, the densified bodies are separated from the pressure transmitting material (PTM) by a method such as pouring the liquid PTM through a screen, the densified bodies being retained on the screen which is described in greater detail in Timm, U.S. Pat. No. 4,744,943, at col. 10, lines 5–27, incorporated herein by reference. Any residual material remaining on the bodies may be removed by, for example, sand blasting. The entire assembly may also be cooled to room temperature before removing the densified bodies. The bodies are subsequently removed from the hardened glass PTM, for example, by breaking the glass PTM with a hammer. Further finishing of the densified bodies such as grinding and polishing may be performed.

The present invention is illustrated by the following, which is provided to demonstrate and clarify various aspects of the present invention. The following should not be construed as limiting the scope of the claimed invention.

Raw materials used preparing a diamond filler composite are listed in Table 1. Source for these materials are known by those skilled in the art and include Kennametal Inc. Latrobe, Pennsylvania, USA, Teledyne Advanced Materials located in Lavergne, Tennessee, OMG headquartered in Cleveland, Ohio, Osram materials corporation located in Towanda, Pa., USA.

About 20 μm single crystal diamonds, about 20 μm nickel coated single crystal diamonds, and about 1000 μm nickel coated polycrystalline pellets each were blended with a spray dried mixture comprising tungsten carbide with about 6 wt. % to about 20 wt. % cobalt for about 45 minutes by mechanical mixing. Each blend was pressed into green bodies that were subsequently subjected to dewaxing. The green bodies were consolidated using ROC at about 1150° C. for a couple of minutes to produce diamond filler cemented tungsten carbides comprising about 0.5 vol. % to about 80 vol. % diamond, respectively. The diamond filler cemented tungsten carbides were difficult to grind and polish. Several of the diamond filler cemented tungsten carbides were cut, mounted, polish to study their microstructures. The results of an examination of the interface between the polycrystalline diamond filler and the cemented tungsten carbide revealed good bonding between them and no diamond degradation. All the materials contained substantially no porosity.

TABLE 1

| Starting Materials | | |
|---|---|---|
| Material | Size | Source |
| Tungsten Carbide | 0.2–40 μm | OMG, Osram, Kennametal |

TABLE 1-continued

| Starting Materials | | |
|---|---|---|
| Cobalt | 0.2–5 μm | OMG, Afro-Met |
| Diamonds | 1–90 μm | GE Superabrasive, Boart, Far East Consulting |

| Copper, Titanium, Nickel or Multilayer W/Cu Coated Diamonds | | |
|---|---|---|
| Type | Size | Source |
| Single Crystal (Cu, Ti or Ni Coated) | ~20 μm | GE Superabrasives |
| Single Crystal (Ni Coated) | 38–45 μm | Far East Consulting |
| Single Crystal (Ni Coated) | 50–63 μm | Far East Consulting |
| Single Crystal (Ni Coated) | 75–90 μm | Far East Consulting |
| Polycrystalline (Ni Coated or w/Cu Multilayer Coated) | ~1000–1500 μm | Custodiam, S.A., Belgium |

TABLE 2

| Diamond Filler Hardmetal Based on WC-13 wt. % Co (38–45 μm nickel coated single crystal diamonds) | | |
|---|---|---|
| Vol. % Diamond | Passes to remove 0.01 inches of Composite | Porosity Rating per ASTM 276–88 |
| 0 | 5 | A00, B00, & C00 |
| 5 | 8 | A00, B00, & C00 |
| 10 | 17 | A00, B00, & C00 |
| 20 | 30 to remove less than 0.005 inch | A00, B00, & C00 |
| 40 | | A00, B00, & C00 |
| 60 | | A00, B00, & C00 |
| 80 | | A00, B00, & C00 |

A series of diamond filler cemented tungsten carbides were prepared substantially as described above except the consolidation temperature comprised about 900° C. for up to about 2 minutes and about 1250° C. for up to about 2 minutes, rather than about 1150° C. for for up to 2 minutes. These diamond filler cemented tungsten carbides possessed characteristic substantially the same are those discussed above.

Another series of diamond filler cemented tungsten carbides bar measuring 1.2×0.26×0.26 inch were prepared substantially as described at about 1050° C. for up to about 2 minutes and as summarized in Table 2. These diamond filler cemented tungsten carbides bars were subjected to grinding using an Okamoto Service Grinder equipped with a polymer bond 120 grit diamond wheel rotating at about 1750 revolution per minute (RPM). The grinder was programmed to remove about 0.002 inch of material each pass. As summarized in Table 2, about 0.01 inch of material were removed from the cemented tungsten carbide after five passes; about 0.01 inch of material were removed from the 5 vol. % diamond filler cemented tungsten carbide after eight passes; and about 0.01 inch of material were removed from the 10 vol. % diamond filler cemented tungsten carbide after seventeen passes. However, after 30 passes not even 0.005 inch of material were removed from the 20 vol. % diamond filler cemented tungsten carbide. To preserve the grinding wheel, the test was stopped. The 40 vol. %, 60 vol. % and 80 vol. % diamond filler cemented tungsten carbide exhibited even greater resistance to grinding.

TABLE 3

Diamond Filler Hardmetal Based on WC-13 wt. % Co (nickel coated single crystal diamonds)

| Vol. % Diamond | Single Crystal size | Porosity Rating per ASTM B 276–88 |
|---|---|---|
| 0 | N/A | A00, B00, & C00 |
| 25 | 38–45 μm | A00, B00, & C00 |
| 50 | 38–45 μm | A00, B00, & C00 |
| 25 | 50–63 μm | A00, B00, & C00 |
| 50 | 50–63 μm | A00, B00, & C00 |
| 25 | 75–90 μm | A00, B00, & C00 |
| 50 | 75–90 μm | A00, B00, & C00 |

Yet another series of diamond filler cemented tungsten carbides were prepared substantially as described at 1050° C. for up to about 2 minutes and as summarized in Table 3.

Other embodiments of the invention will be apparent to those skilled in the art from a consideration of the specification or practice of the invention disclosed herein. For example, the superhard filler hardmetals of the present invention may be used for materials manipulation or removal including, for example, as buttons or inserts or portions of buttons or inserts for oil field tools, a petroleum industry or exploration tools, mining, construction, agricultural, wear, and metal removal applications.

Figure 3A:
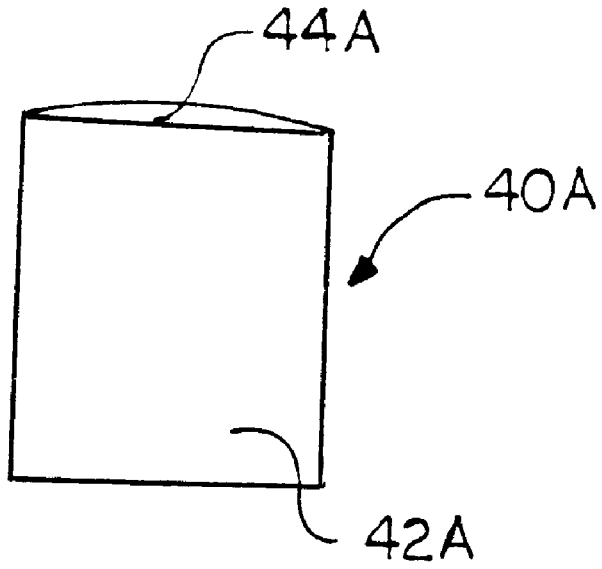
FIGS. 3A and 3B depict buttons having superhard filler hardmetal therein in accordance with the present invention.
Figure 3B:
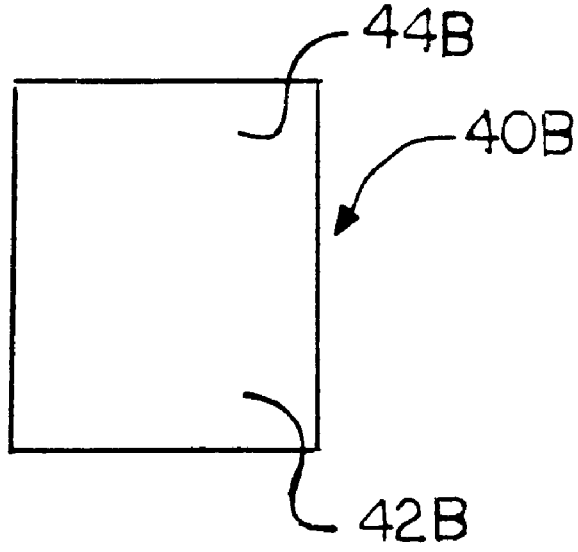

Some examples of oil field tools, petroleum industry or exploration tools include down the hole bits including fixed cutter bits, tricone and rotating percussion bits having hard inserts and/or buttons therein. For example, the hard insert and button in accordance with the present invention may include 5–15 volume percent single crystal diamond (different size ranges: 5 to 45 μm, all nickel coated by electroless plating) or 5 to 25 volume percent polycrystalline diamond cemented tungsten carbide in which the cemented tungsten carbide has about 0.5 to 20 weight percent cobalt. In particular, 25 v/o polycrystalline diamond having a tungsten-copper coating (size range~1000–1500 μm) in a tungsten carbide (2–12 μm), 6–15 weight percent cobalt cemented tungsten carbide should be useful as a button 40A, 40B having a cylindrical body portion 42A, 42B for press fitting into the body of down the hole bit and a portion 44A, 44B for cutting or crushing rock (see FIGS. 3A and B). The entire button 40A, 40B may be made of the composition described above or only the dome portion 44A (or cutting portion 44B) may be of the superhard composition in accordance with the present invention, while the cylindrical body portion 42A, 42B is a cemented tungsten carbide composition without diamond.

Some examples of agricultural applications include inserts for agricultural tools, disc blades, seed boots, stump cutters or grinders, furrowing tools, and earth working tools.

Some examples of mining and construction applications include cutting or digging tools, earth augers, mineral or rock drills, construction equipment blades, rolling cutters, earth working tools, comminution machines, and excavation tools.

More particular examples of mining and construction applications include conical style inserts, or portions thereof, for road milling or road planing rotatable construction bits and rotatable coal mining bits, conical, cylindrical, flat or log cabin style inserts, or portions of inserts, for roof bits, nonrotatable mining bits, auger bits, snowplow blades and scarifier blades.

Some examples of wear applications include nozzles or portions of nozzles for directing abrasive materials such as sand blasting nozzles, waterjet nozzles and abrasive waterjet nozzles. Some examples of materials removal applications include drills, endmills, reamers, threading tools, materials cutting or milling inserts, materials cutting or turning, boring, drilling, milling or sawing inserts, incorporating chip control features, and materials cutting or turning, boring, drilling milling or sawing inserts comprising coating applied by any of chemical vapor deposition (CVD), physical vapor deposition (PVD), conversion coating, etc.

The subject matter of all documents, including patents and patent publications, referred to in the present application is hereby incorporated in its entirety by reference herein.

It is intended that the specification and examples be considered as illustrative only, with the true scope and spirit of the invention being indicated by the following claims.

What is claimed is:

1. A superhard filler hardmetal comprising:

at least a superhard filler and a binder metal or matrix comprising at least one of cobalt, nickel, iron, and alloys thereof, the binder metal or matrix embedding the superhard filler; and the superhard filler hardmetal having a porosity rating of substantially A00, B00 & C00.

2. A superhard filler hardmetal according to claim 1 further comprising at least one first hard component comprising at least one of carbides, nitrides, borides, oxides, mixtures thereof, solid solutions thereof, and combinations thereof, the binder metal or matrix embedding the at least one first hard component.

3. A superhard filler hardmetal according to claim 1 wherein the superhard filler comprises one or more of single crystal material and polycrystalline material.

4. A superhard filler hardmetal according to claim 1 further comprising a coating on the superhard filler.

5. A superhard filler hardmetal according to claim 4 wherein the superhard filler comprises diamond and the coating comprises at least one of iron, cobalt, nickel, boron, titanium, vanadium, chromium, zirconium, hafnium, tantalum, tungsten, molybdenum, niobium and silicon.

6. A superhard filler hardmetal according to claim 5 wherein the coating comprises a thickness up to about 2.0 μm.

7. A superhard filler hardmetal according to claim 1 wherein the superhard filler comprises about 1 vol. % to about 80 vol. %.

8. A superhard filler hardmetal according to claim 2 wherein the superhard filler has a grain size comprising about submicron to about 1500 μm.

9. A superhard filler hardmetal according to claim 2 further comprising a second hard phase comprising at least one of carbides, nitrides, borides, oxides, intermetallics, mixtures thereof, solid solutions thereof, and combinations thereof.

10. A superhard filler hardmetal according to claim 4 wherein the coating is different from the binder metal or matrix.

11. A superhard filler hardmetal according to claim 3 wherein the superhard filler comprises about 1 vol. % to about 80 vol. %.

12. A superhard filler hardmetal according to claim 1 comprising at least a portion of a mining tool, a construction tool, and a material removal tool.

13. A superhard filler hardmetal according to claim 1 wherein the superhard filler comprises at least one of diamond, boron nitride and carbon nitride.

14. A superhard filler hardmetal according to claim 5 wherein the diamond filler has a grain size comprising about sub micron to about 1500 $\mu$m.

15. A superhard filler hardmetal according to claim 2 wherein the binder metal or matrix comprises cobalt and it alloys, the first hard component comprises tungsten carbide, and the coating comprises nickel.

16. A superhard filler hardmetal manufactured by a process comprising the steps of:

forming a mixture by mechanically mixing a superhard filler with a binder metal or matrix precursor;

shaping the mixture into a green body;

consolidating the green body at a preselected temperature, superatmospheric pressure and time at temperature and time at superatmospheric pressure sufficient to form a superhard filler hardmetal, the consolidating occurring without the formation of a liquid in the body and at least a portion of the time at superatmospheric pressure is at the preselected temperature.

17. The superhard filler hardmetal according to claim 16 wherein the said binder metal or said matrix comprising at least one of cobalt, nickel, iron, and alloys thereof, the binder metal or the matrix embedding the superhard filler and at least one hard component.

18. The superhard filler hardmetal according to claim 16 wherein the superatmospheric pressure is applied by rapid omni directional compaction.

19. The superhard filler hardmetal according to claim 16 wherein the time at superatmospheric pressure is less than the time at temperature.

20. The superhard filler hardmetal according to claim 16 wherein the time at superatmospheric pressure is from about 2 seconds to 10 minutes.

21. The superhard filler hardmetal according to claim 16 wherein the time at superatmospheric pressure is from about 2 seconds to about 1 minute.

22. The superhard filler hardmetal according to claim 16 wherein the time at temperature is from about 10 minutes to about 6 hours.

23. The superhard filler hardmetal according to claim 16 wherein the time at temperature is from about 15 minutes to about 1 hour.

24. The superhard filler hardmetal according to claim 16 wherein the mechanical mixing is milling.

25. The superhard filler hardmetal according to claim 16 wherein the superatmospheric pressure is at least about 10,000 pounds per square inch.

26. The superhard filler hardmetal according to claim 25 wherein the superatmospheric pressure is at most about 1,000,000 pounds per square inch.

27. The superhard filler hardmetal according to claim 16 wherein the superatmospheric pressure is at least about 50,000 pounds per square inch.

28. The superhard filler hardmetal according to claim 16 wherein the superatmospheric pressure is at least about 100,000 pounds per square inch.

29. The superhard filler hardmetal according to claim 16 wherein the superatmospheric pressure is at most about6 500,000 pounds per square inch.

30. The superhard filler hardmetal according to claim 16 wherein said porosity rating is in the range of between A00 to A04 and substantially B00.

31. The superhard filler hardmetal according to claim 16 wherein said porosity rating is in the range of between A00 to A02 and substantially B00.

32. The superhard filler hardmetal according to claim 16 wherein said porosity rating is A00 and B00.

33. The superhard filler hardmetal according to claim 30 wherein said hardmental compostion has a porosity rating of C00.

34. The superhard filler hardmetal according to claim 31 wherein said hardmental compostion has a porosity rating of C00.

35. The superhard filler hardmetal according to claim 32 wherein said hardmental compostion has a porosity rating of C00.

36. A superhard filler hardmetal having a porosity rating of substantially A00 manufactured by a process comprising the steps of:

forming a mixture by mechanically mixing a superhard filler with a binder metal or matrix precursor;

shaping the mixture into a green body;

consolidating the green body at a temperature less than 1250 degrees Centigrade, superatmospheric pressure and time at temperature and time at superatmospheric pressure sufficient to form a superhard filler hardmetal.

37. The superhard filler hardmetal according to claim 36 wherein said temperature is between 900 to 1200 degrees Centigrade.

38. The superhard filler hardmetal according to claim 36 wherein said temperature is between 1000 to 1150 degrees Centigrade.

39. The superhard filler hardmetal according to claim 36 wherein said temperature is 1150 degrees Centigrade.

40. A superhard filler hardmetal having a porosity rating of substantially A00 and B00 manufactured by a process comprising the steps of:

forming a mixture by mechanically mixing a superhard filler with a binder metal or matrix precursor;

shaping the mixture into a green body;

consolidating the green body at a temperature less than 1150 degrees Centigrade, superatmospheric pressure and time at temperature and time at superatmospheric pressure sufficient to form a superhard filler hardmetal.

* * * * *